US011282418B2

(12) United States Patent
Liu et al.

(10) Patent No.: US 11,282,418 B2
(45) Date of Patent: Mar. 22, 2022

(54) VOLTAGE REGULATION SYSTEM, DRIVING CIRCUIT, DISPLAY DEVICE AND VOLTAGE REGULATION METHOD

(71) Applicants: Hefei Xinsheng Optoelectronics Technology Co., Ltd., Anhui (CN); BOE Technology Group Co., Ltd., Beijing (CN)

(72) Inventors: Yuanyuan Liu, Beijing (CN); Shuai Liu, Beijing (CN); Xianfeng Yuan, Beijing (CN); Zejun Chen, Beijing (CN); Min Wang, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 605 days.

(21) Appl. No.: 16/329,823

(22) PCT Filed: Sep. 10, 2018

(86) PCT No.: PCT/CN2018/104851
§ 371 (c)(1),
(2) Date: Mar. 1, 2019

(87) PCT Pub. No.: WO2019/062532
PCT Pub. Date: Apr. 4, 2019

(65) Prior Publication Data

US 2021/0358352 A1 Nov. 18, 2021

(30) Foreign Application Priority Data

Sep. 29, 2017 (CN) ..... 201710908807.9

(51) Int. Cl.
*G09G 3/00* (2006.01)

(52) U.S. Cl.
CPC ..... *G09G 3/006* (2013.01); *G09G 2310/08* (2013.01); *G09G 2330/028* (2013.01); *G09G 2330/12* (2013.01)

(58) Field of Classification Search
CPC ..... G09G 3/006; G09G 2310/08; G09G 2330/028; G09G 2330/12; G09G 2330/00; G09G 3/20
See application file for complete search history.

(56) References Cited

U.S. PATENT DOCUMENTS 10,186,182 B2 * 1/2019 Wang ..... G09G 3/2092
2014/0139132 A1 * 5/2014 Kwak ..... G09G 3/006 315/224

FOREIGN PATENT DOCUMENTS

CN 103187875 A 7/2013
CN 105988493 A 10/2016
(Continued)

OTHER PUBLICATIONS

Nov. 28, 2018—(WO) International Search Report and Written Opinion Appn PCT/CN2018/104851 with English Translation.

*Primary Examiner* — Christopher J Kohlman
(74) *Attorney, Agent, or Firm* — Banner & Witcoff, Ltd.

(57) ABSTRACT

A voltage regulation system, a driving circuit, a display device and a voltage regulation method are disclosed. The voltage regulation system, applicable to an electronic device, including a power supply circuit, a determination circuit and a regulation circuit. The power supply circuit is connected with the regulation circuit, and the power supply circuit is configured to provide a reference voltage and provide a first voltage inputted into the electronic device; the determination circuit is connected with the power supply circuit, and the determination circuit is configured to, according to the reference voltage and the first voltage, output a compensation voltage; and the regulation circuit is
(Continued)

connected with the determination circuit so as to receive the compensation voltage, and the regulation circuit is configured to output a third voltage, according to the compensation voltage and a second voltage, in a case where the compensation voltage is not within a preset range.

20 Claims, 7 Drawing Sheets

(56) References Cited

FOREIGN PATENT DOCUMENTS

| | | | |
|---|---|---|---|
| CN | 106847144 | A | 6/2017 |
| CN | 106873688 | A | 6/2017 |
| CN | 107657917 | A | 2/2018 |

* cited by examiner

VOLTAGE REGULATION SYSTEM, DRIVING CIRCUIT, DISPLAY DEVICE AND VOLTAGE REGULATION METHOD

The application is a U.S. National Phase Entry of International Application No. PCT/CN2018/104851 filed on Sep. 10, 2018, designating the United States of America and claiming priority to Chinese Patent Application No. 201710908807.9, filed on Sep. 29, 2017. The present application claims priority to and the benefit of the above-identified applications and the above-identified applications are incorporated by reference herein in their entirety.

TECHNICAL FIELD

Embodiments of the present disclosure relates to a voltage regulation system, a driving circuit, a display device and a voltage regulation method.

BACKGROUND

A timing controller is an important component of a driving circuit of a display panel. The timing controller can convert a signal inputted from a headend system into a control signal required by the display panel through data processing. The timing controller requires two kinds of voltages for generating the control signal: a core voltage and an input/output (I/O) voltage. The core voltage refers to a voltage for driving a core chip of the timing controller. The I/O voltage refers to a voltage for driving an I/O circuit. The timing controller has strict requirements on a voltage and a current of the core voltage. If the core voltage is abnormal, the timing controller will not work properly. Due to the importance of the timing controller to the display panel, if the core voltage is abnormal, the display panel may have the abnormal display phenomena of being abnormally turned on, being repeatedly turned on and off, blurred screen, etc. Therefore, ensuring a stability of the core voltage is very important to improve a stability of the driving circuit of the display panel and prevent the display panel from being abnormally displayed.

SUMMARY

At least one embodiment of the present disclosure provides a voltage regulation system, applicable to an electronic device, comprising a power supply circuit, a determination circuit and a regulation circuit. The power supply circuit is connected with the regulation circuit, and the power supply circuit is configured to provide a reference voltage and provide a first voltage inputted into the electronic device; the determination circuit is connected with the power supply circuit, and the determination circuit is configured to, according to the reference voltage and the first voltage, output a compensation voltage; the regulation circuit is connected with the determination circuit so as to receive the compensation voltage, and the regulation circuit is configured to output a third voltage, according to the compensation voltage and a second voltage, in a case where the compensation voltage is not within a preset range; and the power supply circuit is further configured to provide the first voltage according to the third voltage, and the second voltage is the reference voltage or a voltage acquired based on a variation of the reference voltage.

For example, in the voltage regulation system provided by an embodiment of the present disclosure, the determination circuit is configured to acquire the compensation voltage by performing a difference process between the reference voltage and the first voltage.

For example, in the voltage regulation system provided by an embodiment of the present disclosure, the second voltage is equal to the reference voltage.

For example, the voltage regulation system provided by an embodiment of the present disclosure further comprising a voltage feedback circuit, wherein the voltage feedback circuit is connected with the regulation circuit, and the voltage feedback circuit is configured to acquire the second voltage, according to the reference voltage and the third voltage, when the regulation circuit outputs the third voltage, and provide the second voltage to the regulation circuit.

For example, in the voltage regulation system provided by an embodiment of the present disclosure, the determination circuit comprises a first operational amplifier, a first resistor, a second resistor, a third resistor and a fourth resistor. A first terminal of the first resistor is configured to receive the first voltage, and a second terminal of the first resistor is connected with an inverting input terminal of the first operational amplifier; a first terminal of the second resistor is connected with the inverting input terminal of the first operational amplifier, and a second terminal of the second resistor is connected with an output terminal of the first operational amplifier; a first terminal of the third resistor is configured to receive the reference voltage, and a second terminal of the third resistor is connected with a non-inverting input terminal of the first operational amplifier; a first terminal of the fourth resistor is connected with the non-inverting input terminal of the first operational amplifier, and a second terminal of the fourth resistor is grounded; and the output terminal of the first operational amplifier is configured to output the compensation voltage.

For example, in the voltage regulation system provided by an embodiment of the present disclosure, the regulation circuit comprises a second operational amplifier, a fifth resistor, a sixth resistor, a seventh resistor and an eighth resistor. A first terminal of the fifth resistor is configured to receive the second voltage, and a second terminal of the fifth resistor is connected with an inverting input terminal of the second operational amplifier; a first terminal of the sixth resistor is configured to receive the compensation voltage, and a second terminal of the sixth resistor is connected with the inverting input terminal of the second operational amplifier; a first terminal of the seventh resistor is connected with a non-inverting input terminal of the second operational amplifier, and a second terminal of the seventh resistor is grounded; a first terminal of the eighth resistor is connected with the inverting input terminal of the second operational amplifier, and a second terminal of the eighth resistor is connected with an output terminal of the second operational amplifier; and the output terminal of the second operational amplifier is configured to output the third voltage.

For example, in the voltage regulation system provided by an embodiment of the present disclosure, the eighth resistor is a variable resistor, the eighth resistor comprises N resistors and N first switches, and the regulation circuit further comprises a first processing circuit. The N resistors and the N first switches are in one-to-one correspondence; a first terminal of each resistor of the N resistors is connected with the inverting input terminal of the second operational amplifier through a corresponding first switch, and a second terminal of each resistor of the N resistors is connected with the output terminal of the second operational amplifier; the first processing circuit is connected with the determination circuit and the N first switches of the eighth resistor, and the first processing circuit is configured to control each of the N first switches of the eighth resistor to be in a turn-off state or a turn-on state in a case where the compensation voltage is not within the preset range; and N is an integer greater than 1.

For example, in the voltage regulation system provided by an embodiment of the present disclosure, the regulation circuit further comprises a second switch and a second processing circuits. The second switch is connected with the first terminal of the sixth resistor and the second processing circuit; and the second processing circuit is connected with the determination circuit, and the second processing circuit is configured to control the second switch to be in a turn-off state or a turn-on state.

For example, in the voltage regulation system provided by an embodiment of the present disclosure, the eighth resistor is a variable resistor, the eighth resistor comprises N resistors and N first switches, and the regulation circuit further comprises a processing circuit and a second switch. The N resistors and the N first switches are in one-to-one correspondence; a first terminal of each resistor of the N resistors is connected with the inverting input terminal of the second operational amplifier through a corresponding first switch, and a second terminal of each resistor of the N resistors is connected with the output terminal of the second operational amplifier; the second switch is connected with the first terminal of the sixth resistor and the processing circuit; the processing circuit is connected with the second switch, the determination circuit and the N first switches, the processing circuit is configured to control each of the N first switches to be in a turn-off state or a turn-on state in a case where the compensation voltage is not within the preset range, and the processing circuit is configured to control the second switch to be in a turn-off state or a turn-on state in a case where the compensation voltage is not within the preset range; and N is an integer greater than 1.

For example, in the voltage regulation system provided by an embodiment of the present disclosure, the power supply circuit is disposed in a power control chip.

For example, in the voltage regulation system provided by an embodiment of the present disclosure, the regulation circuit is disposed in the power control chip.

At least one embodiment of the present disclosure provides a voltage regulation method for the voltage regulation system provided by the embodiments of the present disclosure, comprising: allowing the power supply circuit to provide the reference voltage and the first voltage; allowing the determination circuit to acquire the compensation voltage, according to the reference voltage and the first voltage; allowing the regulation circuit to acquire the third voltage, according to the compensation voltage and the second voltage, in a case where the compensation voltage is not within the preset range; and allowing the power supply circuit to provide the first voltage according to the third voltage.

For example, in the voltage regulation method provided by an embodiment of the present disclosure, allowing the determination circuit to acquire the compensation voltage, according to the reference voltage and the first voltage comprises: allowing the determination circuit to acquire the compensation voltage by performing a difference process between the reference voltage and the first voltage.

For example, in the voltage regulation method provided by an embodiment of the present disclosure, in a case where the voltage regulation system comprises a voltage feedback circuit, the voltage regulation method further comprises: providing the third voltage outputted by the regulation circuit to the regulation circuit and taking the third voltage as the second voltage.

For example, in the voltage regulation method provided by an embodiment of the present disclosure, in a case where the voltage regulation system comprises a second switch, a processing circuit and a second operational amplifier, allowing the regulation circuit to acquire the third voltage, according to the compensation voltage and the second voltage comprises: in a case where the processing circuit determines that the compensation voltage is not within the preset range, allowing the second switch to be in a turn-on state, so as to input the compensation voltage into the second operational amplifier.

For example, in the voltage regulation method provided by an embodiment of the present disclosure, in a case where the voltage regulation system comprises a eighth resistor and the eighth resistor is a variable resistor, allowing the regulation circuit to acquire the third voltage, according to the compensation voltage and the second voltage comprises: regulating a voltage value of the third voltage outputted by the regulation circuit by adjusting a resistance of the eighth resistor.

For example, in the voltage regulation method provided by an embodiment of the present disclosure, allowing the regulation circuit to acquire the third voltage, according to the compensation voltage and the second voltage comprises: increasing a voltage value of the third voltage outputted by the regulation circuit if the compensation voltage is greater than a maximum value of the preset range; or reducing the voltage value of the third voltage outputted by the regulation circuit if the compensation voltage is smaller than a minimum value of the preset range.

For example, in the voltage regulation method provided by an embodiment of the present disclosure, the power supply circuit is disposed in a power control chip.

At least one embodiment of the present disclosure provides a driving circuit for driving a timing controller, comprising a power control chip and a determination circuit. The timing controller comprises a core voltage input terminal, the determination circuit comprises a first operational amplifier, a first resistor, a second resistor, a third resistor and a fourth resistor, and the power control chip comprises a reference voltage output terminal, a compensation voltage input terminal, a second voltage input terminal, a third voltage output terminal, a processing circuit, a second operational amplifier, a fifth resistor, a sixth resistor, a seventh resistor, an eighth resistor and a second switch; a first terminal of the first resistor is connected with the core voltage input terminal, and a second terminal of the first resistor is connected with an inverting input terminal of the first operational amplifier; a first terminal of the second resistor is connected with the inverting input terminal of the first operational amplifier, and a second terminal of the second resistor is connected with an output terminal of the first operational amplifier; a first terminal of the third resistor is connected with the reference voltage output terminal, and a second terminal of the third resistor is connected with a non-inverting input terminal of the first operational amplifier; a first terminal of the fourth resistor is connected with the non-inverting input terminal of the first operational amplifier, and a second terminal of the fourth resistor is grounded; the output terminal of the first operational amplifier is connected with the compensation voltage input terminal; the processing circuit is connected with the compensation voltage input terminal and the second switch; the second switch is also connected with a first terminal of the sixth resistor; a second terminal of the sixth resistor is connected with an inverting input terminal of the second operational amplifier; a first terminal of the fifth resistor is connected with the second voltage input terminal, and a second terminal of the fifth resistor is connected with the inverting input terminal of the second operational amplifier; a first terminal of the seventh resistor is connected with a non-inverting input terminal of the second operational amplifier, and a second terminal of the seventh resistor is grounded; a first terminal of the eighth resistor is connected with the inverting input terminal of the second operational amplifier, and a second terminal of the eighth resistor is connected with an output terminal of the second operational amplifier; and the output terminal of the second operational amplifier is connected with the third voltage output terminal.

For example, in the driving circuit provided by an embodiment of the present disclosure, the eighth resistor is a variable resistor, and the eighth resistor comprises N resistors and N first switches. The N resistors and the N first switches are in one-to-one correspondence; a first terminal of each resistor of the N resistors is connected with the inverting input terminal of the second operational amplifier through a corresponding first switch, and a second terminal of each resistor of the N resistors is connected with the output terminal of the second operational amplifier; and N is an integer greater than 1.

At least one embodiment of the present disclosure provides a display device, comprising the voltage regulation system provided by the embodiments of the present disclosure, a timing controller and a display panel. The voltage regulation system is configured to drive the timing controller, and the timing controller is configured to provide control signals to the display panel.

For example, in the display device provided by an embodiment of the present disclosure, the voltage regulation system is configured to provide a core voltage to the timing controller.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1A:
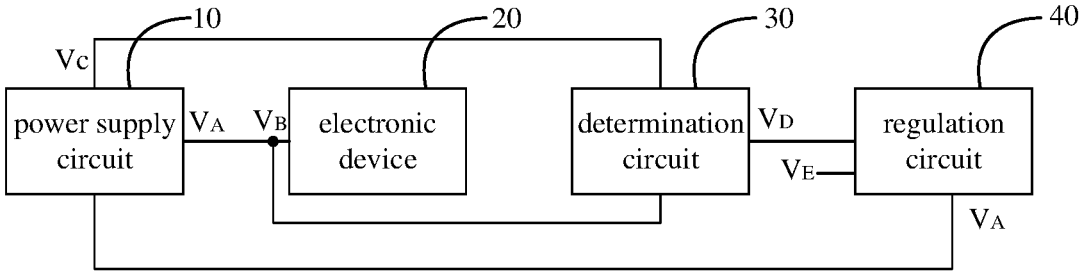
FIG. 1A is a schematic diagram of a voltage regulation system provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

A core voltage required by a timing controller generally provides a greater current than a current provided by a voltage required by other devices. Therefore, in order to ensure a stability of the core voltage of the timing controller, a higher requirement is put forward for the printed circuit board layout (PCB Layout). Generally, in a driving circuit of a display panel, the core voltage is generated by a power control chip. In one design, the stability of the core voltage is ensured by increasing a wiring width of the printed circuit board (PCB) to reduce a wiring loss, thereby ensuring the stability of the core voltage received by the timing controller and ensuring that the timing controller can continue to work normally, thus making the display panel work normally.

The timing controller generally adopts a quad flat no-lead package (QFN). The wiring of the QFN package in the PCB layout does not need to pass through an integrated circuit (IC) to make the wiring space large, so increasing the wiring width is achievable, and the implementation is simple and low cost. However, with a development of the display panel industry, a resolution and a refresh frequency of the display panel are gradually improved, and a number of pins of the timing controller is gradually increased. The timing controller adopting the QFN package cannot meet the demand, and a pin grid array packaging (PGA) technology gradually replaces the QFN package.

On the PCB, the pins of the PGA package are under the IC, a pitch between two pins is limited, the wiring space is limited, so the wiring width is also limited. Thus, the method of ensuring the stability of the core voltage by increasing the wiring width is not feasible, and the effectiveness cannot be guaranteed. In addition, if the display panel is in different operating environments or as a running time is lengthened, a power consumption will increase, the current of the core voltage will also increase, and then the wiring loss will also increase. Therefore, in addition to the limitations of the package, this situation also reduces the effectiveness of the method which ensuring the stability of the core voltage by increasing the wiring width.

In summary, in a case where the stability of the core voltage inputted into the timing controller is ensured by increasing the wiring width, the requirements on the resolution and the refresh frequency of the display panel cannot be satisfied in a process of packaging the timing controller using the QFN technology. In addition, the feasibility of using the PGA technology to package the timing controller is not high, and the effectiveness cannot be guaranteed. In addition, the operating environment and the running time of the display panel also limit the core voltage provided to the timing controller, so the stability and the effectiveness of the core voltage ultimately provided to the timing controller are reduced. Therefore, increasing the wiring width cannot ensure the stability of the core voltage inputted into the timing controller, resulting in a decrease in the stability of the driving circuit of the display panel, and an abnormal display may occur on the display panel.

At least one embodiment of the present disclosure provides a voltage regulation system, applicable to an electronic device. The voltage regulation system can self-regulate the voltage provided to the electronic device and then improve the stability of the electronic device. At least one embodiment of the present disclosure further provides a driving circuit and a voltage regulation method corresponding to the voltage regulation system.

The embodiments of the present disclosure are described in detail in the following with reference to the accompany drawings.

Some embodiments of the present disclosure provide a voltage regulation system, as shown in FIG. 1A, the voltage regulation system is applicable to an electronic device 20. The voltage regulation system includes a power supply circuit 10, a determination circuit 30 and a regulation circuit 40.

The power supply circuit 10 is connected with the electronic device 20, the determination circuit 30 and the regulation circuit 40, and the power supply circuit 10 is configured to provide a reference voltage $V_C$ inputted into the determination circuit 30 and provide a first voltage $V_B$ inputted into the electronic device 20. For example, in an example, the reference voltage $V_C$ can be provided to the determination circuit 30 for a subsequent processing. For example, the first voltage $V_B$ inputted into the electronic device 20 can be taken as a core voltage of the electronic device 20. For example, the core voltage is a voltage of a core chip for driving the electronic device 20.

It should be noted that in the following description, the first voltage $V_B$ in the embodiments of the present disclosure refers to a voltage inputted into the electronic device 20, and the voltage, for example, is a voltage inputted into the core chip of the electronic device 20. That is, the first voltage $V_B$ is a voltage on a side close to the electronic device 20, namely a receiving voltage received by the electronic device 20, and is not an output voltage on a side close to the power supply circuit 10. The receiving voltage and the output voltage may be different due to a voltage drop of wiring.

For example, in an example, the power supply circuit 10 can be disposed in a power control chip.

The determination circuit 30 is connected with the power supply circuit 10 and the regulation circuit 40, and the determination circuit is configured to output a compensation voltage $V_D$, according to the reference voltage $V_C$ and the first voltage $V_B$. For example, the determination circuit 30 can directly receive the reference voltage $V_C$ provided by the power supply circuit 10. For example, the determination circuit 30 can acquire the first voltage $V_B$ on a side close to the electronic device 20, and the first voltage $V_B$ is provided to the electronic device 20 by the power supply circuit 10. After acquiring the reference voltage $V_C$ and the first voltage $V_B$, the determination circuit 30 can process the reference voltage $V_C$ and the first voltage $V_B$ and then output the compensation voltage $V_D$. For example, the compensation voltage $V_D$ can be provided to the regulation circuit 40 for a subsequent processing.

For example, in an example, the determination circuit 30 is configured to acquire the compensation voltage $V_D$ by performing a difference process between the reference voltage $V_C$ and the first voltage $V_B$, that is, the compensation voltage $V_D$ can be a difference between the reference voltage $V_C$ and the first voltage $V_B$.

The regulation circuit 40 is connected with the determination circuit 30 so as to receive the compensation voltage $V_D$, and the regulation circuit 40 is configured to output a third voltage $V_A$, according to the compensation voltage $V_D$ and a received second voltage $V_E$, in a case where the compensation voltage $V_D$ is not within a preset range. For example, the third voltage $V_A$ outputted by the regulation circuit 40 can be provided to the power supply circuit 10, and the power supply circuit 10 regulates an output voltage based on the third voltage $V_A$. For example, in some embodiments, the regulation circuit 40 and the power supply circuit 10 can be disposed in a same IC or a same chip. For example, in a case where the power supply circuit 10 is disposed in the power control chip, the regulation circuit 40 may also be disposed in the power control chip, so as to simplify a circuit structure.

For example, the power supply circuit 10 is further configured to generate or regulate the provided first voltage $V_B$ according to the third voltage $V_A$. For example, in an example, a wiring can be disposed between the power supply circuit 10 and the electronic device 20 (for example, the core chip in the electronic device 20). The power supply circuit 10 can directly output the third voltage $V_A$, and the third voltage $V_A$ is transmitted to the electronic device 20 through the above wiring and converted into the first voltage $V_B$ inputted into the electronic device 20, that is, the power supply circuit 10 provides the first voltage $V_B$ according to the third voltage $V_A$. For example, in a case where a current on the wiring is large, the third voltage $V_A$ has a voltage drop during transmission, which may cause the first voltage $V_B$ inputted into the electronic device 20 to be smaller than the third voltage $V_A$.

For example, in an example, the second voltage $V_E$ is the reference voltage $V_C$, that is, the second voltage $V_E$ is equal to the reference voltage $V_C$. For example, the regulation circuit 40 can be connected with the power supply circuit 10, and the regulation circuit 40 can receive the reference voltage $V_C$ provided by the power supply circuit 10 and take the reference voltage $V_C$ as the second voltage $V_E$. For example, in the first voltage regulation, the regulation circuit 40 can output the third voltage $V_A$, according to the reference voltage $V_C$ and the compensation voltage $V_D$.

For another example, in another example, the second voltage $V_E$ may also be a voltage acquired based on a variation of the reference voltage $V_C$. For example, in the $n^{th}$ voltage regulation, the regulation circuit 40 outputs the third voltage $V_A$, according to the reference voltage $V_C$ and the compensation voltage $V_D$; and subsequently, in the $(n+1)^{th}$ voltage regulation, the regulation circuit 40 can take the third voltage $V_A$ outputted in the $n^{th}$ voltage regulation as the second voltage $V_E$ required by the $(n+1)^{th}$ voltage regulation. For example, in each subsequent voltage regulation, the regulation circuit 40 can take the third voltage $V_A$ outputted in the last voltage regulation as the second voltage $V_E$ required by this voltage regulation, and n is an integer greater than zero.

Figure 1B:
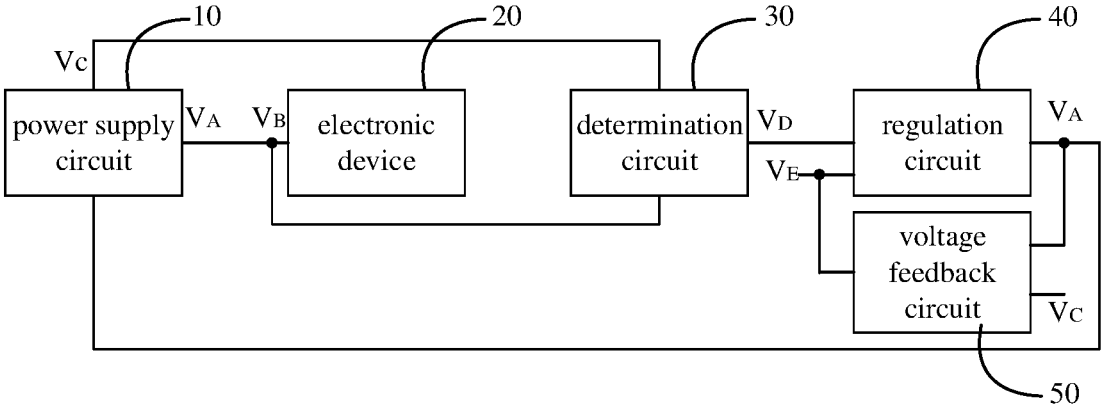
FIG. 1B is a schematic diagram of another voltage regulation system provided by some embodiments of the present disclosure.

In the voltage regulation system provided by some embodiments of the present disclosure, as shown in FIG. 1B, the voltage regulation system further includes a voltage feedback circuit 50. The voltage feedback circuit 50 is connected with the regulation circuit 40, and the voltage feedback circuit 50 is configured to acquire the second voltage $V_E$, according to the reference voltage $V_C$ and the third voltage $V_A$, when the regulation circuit 40 outputs the third voltage $V_A$, and provide the second voltage $V_E$ to the regulation circuit 40. For example, in the $n^{th}$ voltage regulation, the regulation circuit 40 outputs the third voltage $V_A$, and the third voltage $V_A$ can be provided to the voltage feedback circuit 50, and meanwhile, the voltage feedback circuit 50 can also receive the reference voltage $V_C$ provided by the power supply circuit 10; and subsequently, in the $(n+1)^{th}$ voltage regulation, the voltage feedback circuit 50 can acquire the second voltage $V_E$, according to the reference voltage $V_C$ and the third voltage $V_A$, and provide the second voltage $V_E$ to the regulation circuit 40 for a voltage regulation. For example, the second voltage $V_E$ obtained by the regulation circuit 40 in the $(n+1)^{th}$ voltage regulation is equal to the third voltage $V_A$ outputted by the regulation 40 in the $n^{th}$ voltage regulation.

For example, in an example, the voltage feedback circuit 50 includes an analog to digital conversion circuit and a voltage conversion circuit. For example, after the voltage feedback circuit 50 receives the third voltage $V_A$, the analog to digital conversion circuit can be adopted to convert the third voltage $V_A$ into a corresponding digital signal, and the digital signal, for example, can be stored in a memory or a register; and subsequently, the voltage conversion circuit can generate the second voltage $V_E$, according to the digital signal and the reference voltage $V_C$, and the second voltage $V_E$ is equal to the third voltage $V_A$.

The voltage regulation system provided by the embodiment of the present disclosure can regulate and stabilize the first voltage $V_B$ inputted into the electronic device 20, so the core voltage acquired by the electronic device 20 can be kept stable. For example, in an embodiment, the stable core voltage required by the electronic device 20 is 1.2V and the preset range of the compensation voltage $V_D$ is −0.2V~0.2V, and if the first voltage $V_B$ provided to the electronic device 20 by the power supply circuit 10 is within a range of 1V~1.4V, it is considered that the core voltage acquired by the electronic device 20 is kept stable. For example, the reference voltage $V_C$ provided by the power supply circuit 10 can also be 1.2V.

Detailed descriptions of a working process of the voltage regulation system will be given below by taking the embodiment as shown in FIG. 1B as an example.

For example, in the first voltage regulation, in the embodiment as shown in FIG. 1B, the power supply circuit 10 provides the third voltage $V_A$ and the reference voltage $V_C$, and for example, both the third voltage $V_A$ and the reference voltage $V_C$ are 1.2V. After the third voltage $V_A$ is transmitted via a wiring, as the wiring has a voltage drop, the first voltage $V_B$ inputted into the electronic device is smaller than the third voltage $V_A$. For example, the first voltage $V_B$ is becomes 0.9V, that is, the voltage drop on the wiring is 0.3V. For example, the determination circuit 30 obtains the compensation voltage $V_D$ by performing a difference process between the reference voltage $V_C$ and the first voltage $V_B$, that is, the compensation voltage $V_D$ is 1.2V−0.9V=0.3V. For example, after receiving the compensation voltage $V_D$, the regulation circuit 40 determines that the compensation voltage $V_D$ is not within the above preset range of −0.2V~0.2V at first, and then outputs the third voltage $V_A$, according to the compensation voltage $V_D$ and the second voltage $V_E$ (in the example, the second voltage $V_E$ is the reference voltage $V_C$). For example, the third voltage $V_A$ is obtained by performing a summation process between the compensation voltage $V_D$ (0.3V) and the second voltage $V_E$ (1.2V), and third voltage $V_A$ is 1.5V. Subsequently, the third voltage $V_A$ is directly provided to the power supply circuit 10, and the power supply circuit 10 outputs the third voltage $V_A$. Supposing the voltage drop on the wiring is still 0.3V at the moment, the third voltage $V_A$ is converted into 1.2V after transmitted to the electronic device 20, that is, the first voltage $V_B$ is 1.2V after a voltage regulation, and the first voltage $V_B$ is provided to the electronic device 20 by the power supply circuit 10.

As described above, the first voltage $V_B$ provided by the power supply circuit 10 can satisfy the requirement by a regulation adopting the voltage regulation system. In the example, the regulation circuit 40 adopts the reference voltage $V_C$ as the second voltage $V_E$, so the voltage feedback circuit 50 as shown in FIG. 1B may be not arranged.

For example, if circuit parameters (for example, the voltage drop of the wiring, the resistance of the resistor, etc.) change or environmental parameters (for example, a temperature) change, the regulated first voltage $V_B$ provided by the power supply circuit 10 previously may change. For example, if the voltage drop on the wiring is changed from a previous 0.3V to 0.7V, the first voltage $V_B$ provided by the power supply circuit 10 will be reduced from 1.2V to 0.8V. Thus, the voltage received by the electronic device 20 no longer satisfies the requirement of the core voltage required by the electronic device 20, and a second voltage regulation needs to be continued. For example, the reference voltage $V_C$ provided by the power supply circuit 10 is kept unchanged and is still 1.2V, and the determination circuit 30 can obtain the compensation voltage $V_D$ by performing a difference process between the reference voltage $V_C$ (1.2V) and the first voltage $V_B$ (0.8V), that is, the compensation voltage $V_D$ is 0.4V. For example, after receiving the compensation voltage $V_D$, the regulation circuit 40 determines that the compensation voltage $V_D$ is not within the preset range of −0.2V~0.2V at first, and then outputs the third voltage $V_A$, according to the compensation voltage $V_D$ and the second voltage $V_E$ (in the example, the second voltage $V_E$ is the third voltage $V_A$ outputted by the regulation circuit 40 in the first voltage regulation, namely 1.5V). For example, the third voltage $V_A$ is obtained by performing a summation process between the compensation voltage $V_D$ (0.4V) and the second voltage $V_E$ (1.5V), and the third voltage $V_A$ is 1.9V. Subsequently, the third voltage $V_A$ is directly provided to the power supply circuit 10, and the power supply circuit 10 outputs the third voltage $V_A$. Supposing the voltage drop on the wiring is still 0.7V at the moment, the third voltage $V_A$ becomes 1.2V after being transmitted to the electronic device 20, that is, the first voltage $V_B$ provided to the electronic device 20 by the power supply circuit 10 is 1.2V.

As described above, after the first voltage regulation is completed, if the circuit changes and results in that the first voltage $V_B$ cannot satisfy the requirement, the voltage regulation system can still regulate the first voltage $V_B$ to satisfy the requirement of the core voltage of the electronic device 20. In the example, the voltage feedback circuit 50 as shown in FIG. 1B needs to be arranged.

It should be noted that, for example, there are two independent loops in the power supply circuit 10, the two independent loops can respectively generate the third voltage $V_A$ and the reference voltage $V_C$, and the two independent loops are independent of each other and do not affect each other.

The mode of generating the third voltage $V_A$ by the power supply circuit 10 includes, but not limited to, parts or all of the following circuits: buck conversion circuit, boost conversion circuit and other circuits.

For example, when the voltage regulation system starts working, that is, in the first voltage regulation, both the third voltage $V_A$ and the reference voltage $V_C$ outputted by the power supply circuit 10 are equal to the core voltage required by the electronic device 20 and, for example, are 1.2V. Subsequently, in the subsequent voltage regulation, the power supply circuit 10 can receive the third voltage $V_A$ outputted by the regulation circuit 40 and directly output the third voltage $V_A$ so as to provide the first voltage inputted into the electronic device 20.

In summary, the voltage regulation system provided by the embodiment of the present disclosure can regulate and stabilize the voltage (for example, the core voltage required by the electronic device) provided to the electronic device and then improve the stability of the electronic device. For example, in an embodiment, the power supply circuit 10 can be disposed in the power control chip, and the electronic device 20 is a timing controller in a driving circuit of a display panel. Increasing the stability of the timing controller can improve the stability of the driving circuit of the display panel, thereby avoiding an abnormal display of the display panel.

The first voltage $V_B$ inputted into the electronic device 20 is provided by the power supply circuit 10. The current of the third voltage $V_A$ outputted by the power supply circuit 10 is large, and there is a large wiring loss during transmission, so the first voltage $V_B$ inputted into the electronic device 20 is smaller than the third voltage $V_A$. Based on this, in a process of acquiring the first voltage $V_B$ inputted into the electronic device 20, the first voltage can be acquired on a side close to the electronic device 20.

Figure 2:
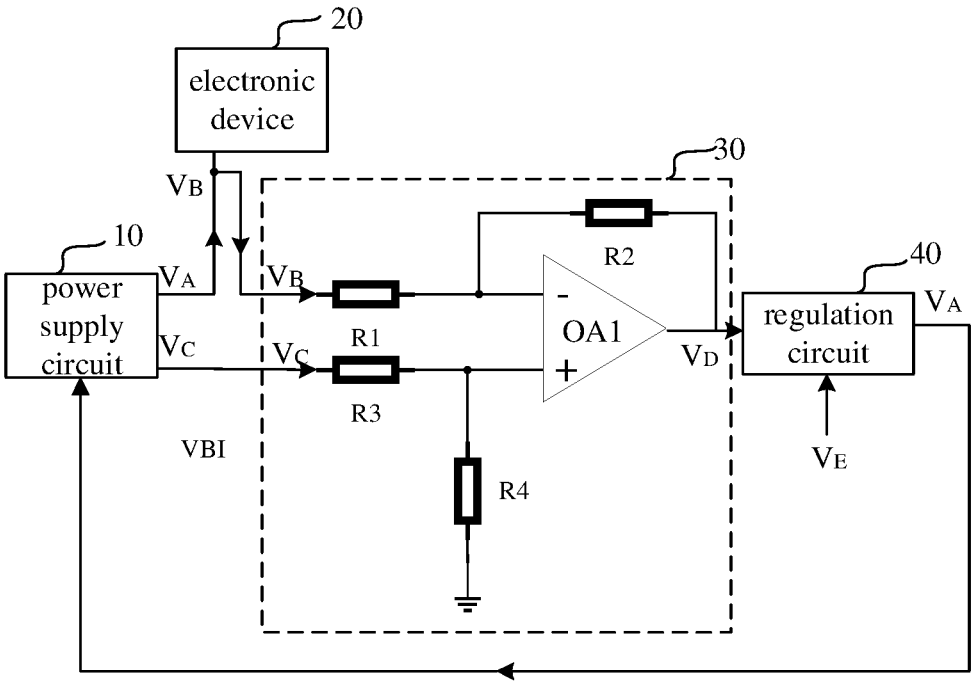
FIG. 2 is a circuit diagram of a determination circuit provided by some embodiments of the present disclosure.

In the embodiment as shown in FIG. 2, for example, the third voltage $V_A$ outputted by the power supply circuit 10 is 1.2V, and due to the wiring loss of the transmission wiring, the first voltage $V_B$ inputted into the electronic device 20 is 0.9V. In the embodiment of the present disclosure, the first voltage $V_B$ inputted into the electronic device 20 is acquired on a side of a core voltage input terminal of the electronic device 20.

For example, as shown in FIG. 2, the determination circuit 30 includes: a first operational amplifier OA1, a first resistor R1, a second resistor R2, a third resistor R3 and a fourth resistor R4.

A first terminal of the first resistor R1 is configured to receive the first voltage $V_B$, and a second terminal of the first resistor R1 is connected with an inverting input terminal of the first operational amplifier OA1.

A first terminal of the second resistor R2 is connected with the inverting input terminal of the first operational amplifier OA1, and a second terminal of the second resistor R2 is connected with an output terminal of the first operational amplifier OA1.

A first terminal of the third resistor R3 is configured to receive the reference voltage $V_C$, and a second terminal of the third resistor R3 is connected with a non-inverting input terminal of the first operational amplifier OA1.

A first terminal of the fourth resistor R4 is connected with the non-inverting input terminal of the first operational amplifier OA1, and a second terminal of the fourth resistor R4 is grounded.

The output terminal of the first operational amplifier OA1 is connected with the regulation circuit 40 and is configured to output the compensation voltage $V_D$.

In the circuit as shown in FIG. 2, the first voltage $V_B$ acquired on the side close to the electronic device 20 is inputted into the inverting input terminal of the first operational amplifier OA1 through the first resistor R1, and the reference voltage $V_C$ outputted by the power supply circuit 10 is inputted into the non-inverting input terminal of the first operational amplifier OA1 through the third resistor R3. Thus, if the first resistor R1, the second resistor R2, the third resistor R3 and the fourth resistor R4 satisfy a certain condition, the voltage outputted by the first operational amplifier OA1 is a difference between the two inputted voltages.

For example, the current of the third voltage $V_A$ outputted by the power supply circuit is large, and there is a large wiring loss during transmission, so the first voltage $V_B$ inputted into the first operational amplifier OA1 is smaller than the third voltage $V_A$.

For example, the third voltage $V_A$ outputted by the power supply circuit 10 is 1.2V, and due to the influence of the wiring loss, the first voltage $V_B$ inputted into the first operational amplifier OA1 may be 0.9V. For example, in the PCB layout, the inverting input terminal of the first operational amplifier OA1 is close to the core voltage input terminal of the electronic device 20.

For example, the reference voltage $V_C$ outputted by the power supply circuit 10 is 1.2V.

For example, as the current of the reference voltage $V_C$ outputted by the power supply circuit 10 is small, so in the case where the PCB layout is reasonable, the wiring loss of the reference voltage $V_C$ during transmission can be ignored, and the voltage value transmitted to the non-inverting input terminal of the first operational amplifier OA1 is unchanged and is still the reference voltage $V_C$=1.2V.

For example, the power supply circuit 10 includes a loop for outputting the reference voltage $V_C$, and the loop is completely independent and does not be affected by other voltages.

In the circuit as shown in FIG. 2, the compensation voltage $V_D$ outputted by the first operational amplifier OA1 can be determined according to the following formula:

$$VD=(R4/(R3+R4))*((R1+R2)/R1)*VC-(R2/R1)*VB$$

For example, in order to guarantee the accuracy of the compensation voltage $V_D$ outputted by the determination circuit 30, in an embodiment, the resistance of the first resistor R1 and the resistance of the third resistor R3 are equal, and the resistance of the second resistor R2 and the resistance of the fourth resistor R4 are equal, so the above formula can be simplified as: $V_D=(R2/R1)*(V_C-V_B)$. For another example, the resistance of the first resistor R1 and the resistance of the second resistor R2 are equal, so the above formula can be further simplified as $V_D=V_C-V_B$, that is, the compensation voltage $V_D$ outputted by the determination circuit 30 is a difference between the reference voltage $V_C$ and the first voltage $V_B$.

In the embodiment of the present disclosure, the difference between the reference voltage $V_C$ outputted by the power supply circuit 10 and the first voltage $V_B$ inputted into the electronic device 20, namely the compensation voltage $V_D$, can be accurately calculated by the first operational amplifier OA1.

It should be noted that, the circuit diagram as shown in FIG. 2 is only illustrative, and any circuit being capable of determining the difference between the reference voltage $V_C$ outputted by the power supply circuit 10 and the first voltage $V_B$ inputted into the electronic device 20 by an operational amplifier is applicable to the embodiment of the present disclosure.

Figure 3:
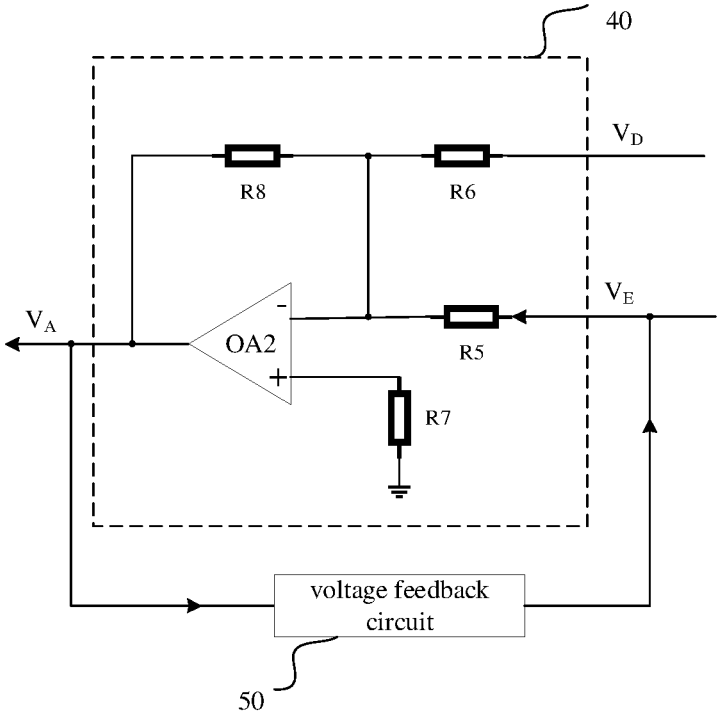
FIG. 3 is a circuit diagram of a regulation circuit provided by some embodiments of the present disclosure.

For example, as shown in FIG. 3, in the voltage regulation system provided by some embodiments of the present disclosure, the regulation circuit 40 includes: a second operational amplifier OA2, a fifth resistor R5, a sixth resistor R6, a seventh resistor R7 and an eighth resistor R8.

A first terminal of the fifth resistor R5 is configured to receive the second voltage $V_E$, and a second terminal of the fifth resistor R5 is connected with an inverting input terminal of the second operational amplifier OA2.

A first terminal of the sixth resistor R6 is configured to receive the compensation voltage $V_D$, and a second terminal of the sixth resistor R6 is connected with the inverting input terminal of the second operational amplifier OA2.

A first terminal of the seventh resistor R7 is connected with a non-inverting input terminal of the second operational amplifier OA2, and a second terminal of the seventh resistor R7 is grounded.

A first terminal of the eighth resistor R8 is connected with the inverting input terminal of the second operational amplifier OA2, and a second terminal of the eighth resistor R8 is connected with an output terminal of the second operational amplifier OA2.

The output terminal of the second operational amplifier OA2 is configured to output the third voltage $V_A$. For example, the third voltage $V_A$ can be transmitted to the power supply circuit 10, so the power supply circuit 10 can provide the first voltage $V_B$ according to the third voltage $V_A$.

For example, as shown in FIG. 2, the compensation voltage $V_D$ is the voltage outputted by the first operational amplifier OA1 in the determination circuit 30 (that is, the difference between the reference voltage $V_C$ outputted by the power supply circuit 10 and the first voltage $V_B$ inputted into the electronic device 20, determined by the determination circuit 30), and the second voltage $V_E$ is the reference voltage $V_C$ outputted by the power supply circuit 10 or the voltage outputted by the voltage feedback circuit 50.

For example, as shown in FIG. 3, in an example, the resistors R5, R6, R7 and R8 are resistors with a fixed resistance. In a case where the regulation circuit 40 determines that the received compensation voltage $V_D$ is not within the preset range, the regulation circuit 40 can process the compensation voltage $V_D$ and the second voltage $V_E$ and then output the third voltage $V_A$. The outputted third voltage $V_A$, for example, can be transmitted to the power supply circuit 10, and the third voltage $V_A$ is outputted by the power supply circuit 10 and finally inputted into the electronic device 20.

In the circuit as shown in FIG. 3, the third voltage $V_A$ outputted by the second operational amplifier OA2 can be determined by the following formula:

$$V_A=R8*(V_D/R6+V_E/R5)$$

For example, in an embodiment, the resistance can be set to be R5=R6=R8, so the above formula can be simplified as: $V_A=V_D+V_E$.

In the embodiment, the regulation circuit 40 is adopted to process the compensation voltage $V_D$ and the second voltage $V_E$ and then output the third voltage $V_A$, thereby ensuring that the first voltage $V_B$ transmitted to the electronic device 20 can be within a stable range and, for example, avoiding the abnormal display of the display panel during work.

Figure 4:
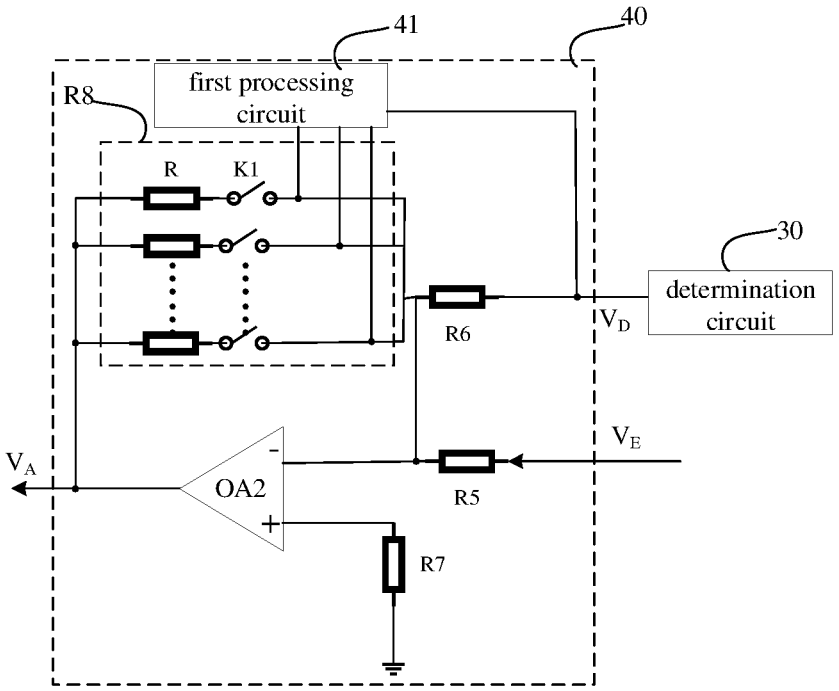
FIG. 4 is a circuit diagram of another regulation circuit provided by some embodiments of the present disclosure.

For example, as shown in FIG. 4, in another embodiment of the present disclosure, the eighth resistor R8 is a variable resistor and includes N resistors R and N first switches K1; and the regulation circuit 40 further includes a first processing circuit 41.

The N resistors R and the N first switches K1 are in one-to-one correspondence. A first terminal of each resistor R of the N resistors is connected with the inverting input terminal of the second operational amplifier OA2 through a corresponding first switch K1, and a second terminal of each resistor R of the N resistors is connected with the output terminal of the second operational amplifier OA2.

The first processing circuit 41 is connected with the determination circuit 30 and the N first switches K1 of the eighth resistor R8, and the first processing circuit is configured to control each of the N first switches K1 of the eighth resistor R8 to be in a turn-off state or a turn-on state in a case where the compensation voltage $V_D$ is not within the preset range. N is an integer greater than 1.

For example, the eighth resistor R8 includes two and/or more than two resistors R, and a number of the resistors R in the eighth resistor R8 and the resistance of each resistor R can be determined experimentally according to application scenes, requirements, and the like.

For example, the determination circuit 30 inputs the difference between the reference voltage $V_C$ outputted by the power supply circuit 10 and the first voltage $V_B$ which is provided by the power supply circuit 10 and is inputted into the electronic device 20, namely the compensation voltage $V_D$, into the first processing circuit 41 of the regulation circuit 40; the first processing circuit 41 determines whether the compensation voltage $V_D$ is within the preset range according to the value of the received compensation voltage $V_D$; if the compensation voltage $V_D$ is not within the preset range, the first processing circuit 41 can control the N first switches K1 of the eighth resistor R8 and turn on one or more of the N first switches K1 of the eighth resistor R8, so as to regulate the resistance of the eighth resistor R8 and then regulate the third voltage $V_A$ outputted by the second operational amplifier OA2; and the outputted third voltage $V_A$, for example, can be outputted through the power supply circuit 10 and finally inputted into the electronic device 20.

In the embodiment of the present disclosure, in a case where the eighth resistor R8 is a variable resistor, the resistance of the eighth resistor R8 can be changed by adjusting states of the plurality of first switches K1 of the eighth resistor R8, thereby achieving a purpose of regulating the third voltage $V_A$. Thus, the first voltage $V_B$ finally transmitted to the electronic device 20 is within a stable range.

Figure 5:
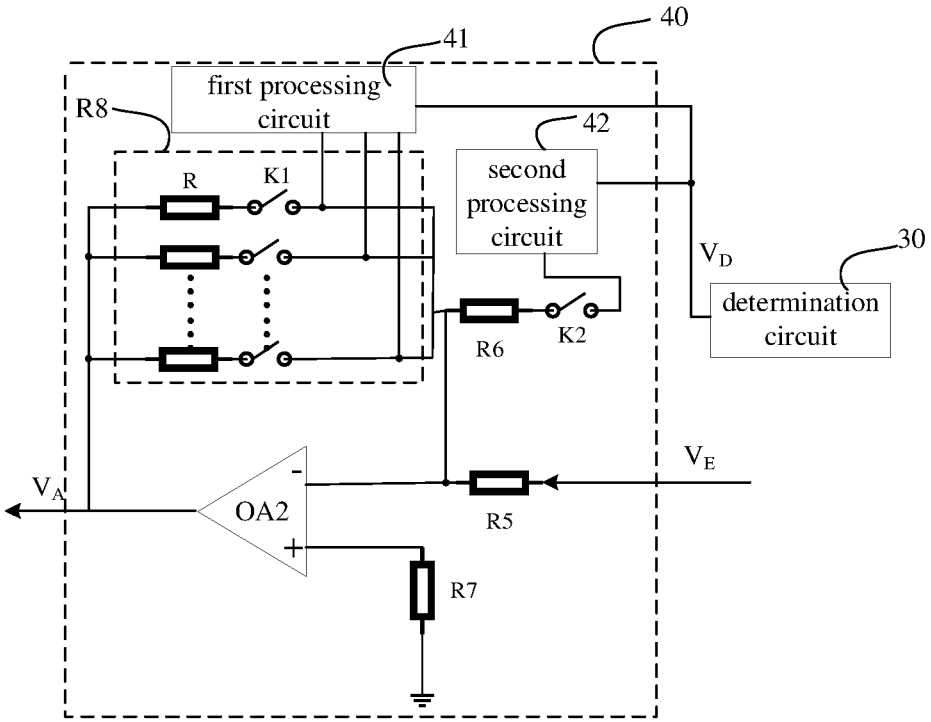
FIG. 5 is a circuit diagram of another regulation circuit provided by some embodiments of the present disclosure.

For example, as shown in FIG. 5, in another embodiment of the present disclosure, the regulation circuit 40 of the voltage regulation system further includes a second switch K2 and a second processing circuit 42.

The second switch K2 is connected with the first terminal of the sixth resistor R6 and the second processing circuit 42. The second processing circuit 42 is connected with the determination circuit 30, and the second processing circuit 42 is configured to control the second switch K2 to be in a turn-off state or a turn-on state.

For example, in the circuit as shown in FIG. 5, in a case where the second processing circuit 42 receives the compensation voltage $V_D$ and determines that the compensation voltage $V_D$ is within the preset range, the second processing circuit 42 can control the second switch K2 to make the second switch K2 in a turn-off state, and at the moment, the inverting input terminal of the second operational amplifier OA2 only receives the second voltage $V_E$ inputted through the fifth resistor R5; and in a case where the second processing circuit 42 determines that the compensation voltage $V_D$ is not within the preset range, the second processing circuit 42 can control the second switch K2 to make the second switch K2 in a turn-on state, and at the moment, the inverting input terminal of the second operational amplifier OA2 can simultaneously receive the second voltage $V_E$ inputted through the fifth resistor R5 and the compensation voltage $V_D$ inputted through the sixth resistor R6.

In the embodiment as shown in FIG. 5, the second processing circuit 42 and the second switch K2 are disposed between the determination circuit 30 and the sixth resistor R6, and in a case where the compensation voltage $V_D$ is not within the preset range, the second processing circuit 42 controls the second switch K2 to be in a turn-on state. By adoption of this means, in a case where the compensation voltage $V_D$ does not exceed the preset range, that is, in a case where the first voltage $V_B$ inputted into the electronic device 20 is within the stable range, a load of the circuit can be reduced, and then a power consumption of the circuit can be reduced.

Figure 6:
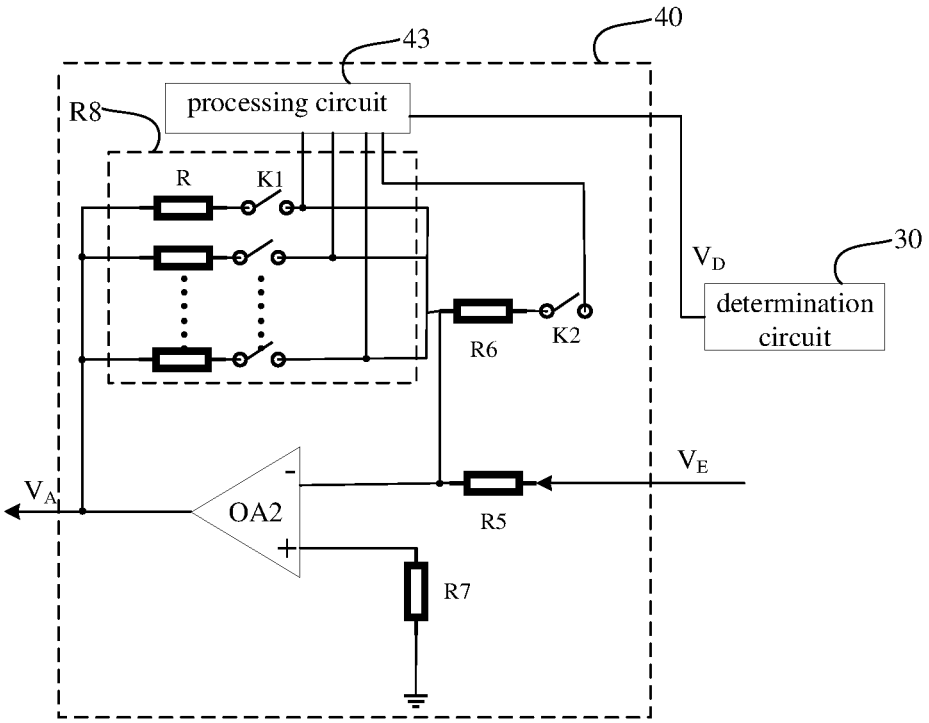
FIG. 6 is a circuit diagram of another regulation circuit provided by some embodiments of the present disclosure.

For example, as shown in FIG. 6, in another embodiment of the present disclosure, the eighth resistor R8 is a variable resistor, and the eighth resistor R8 includes N resistors R and N first switches K1; and the regulation circuit 40 further includes a processing circuit 43 and a second switch K2.

The N resistors R and the N first switches K1 are in one-to-one correspondence. A first terminal of each resistor R of the N resistors R is connected with the inverting input terminal of the second operational amplifier OA2 through a corresponding first switch K1, and a second terminal of each resistor R of the N resistors R is connected with the output terminal of the second operational amplifier OA2. The second switch K2 is connected with the first terminal of the sixth resistor R6 and the processing circuit 43.

The processing circuit 43 is connected with the second switch K2, the determination circuit 30 and the N first switches K1, and the processing circuit is configured to control each of the N first switches K1 to be in a turn-off state or a turn-on state in a case where the compensation voltage $V_D$ is not within the preset range, and the processing circuit is configured to control the second switch to be in a turn-off state or a turn-on state in a case where the compensation voltage is not within the preset range. N is an integer greater than 1.

For example, as shown in FIG. 6, the processing circuit 43 of the regulation circuit 40 is not only connected with the N first switches K1 of the eighth resistor R8 but also connected with the second switch K2. After receiving the compensation voltage $V_D$ outputted by the determination circuit 30, the processing circuit 43 of the regulation circuit 40 determines whether the compensation voltage $V_D$ is within the preset range at first, then the processing circuit 43 can control the N first switches of the eighth resistor R8 to be in a turn-off state or a turn-on state according to a determination result, and meanwhile, the processing circuit 43 can also control the second switch K2 to be in a turn-off state or a turn-on state according to the determination result. For example, in a case where the compensation voltage $V_D$ is not within the preset range, the processing circuit 43 can control one or more resistors R of the eighth resistor R8 to be in the turn-on state, and meanwhile control the second switch K2 to be in the turn-on state.

In the embodiment, the processing circuit 43 is adopted to simultaneously control the N first switches K1 of the eighth resistor R8 and the second switch K2 to be in the turn-off state or the turn-on state, so the compensation voltage $V_D$ outputted by the first operational amplifier OA1 can be inputted into the second operational amplifier OA2, and meanwhile, the resistance of the eighth resistor R8 can be adjusted to ensure that the third voltage $V_A$ outputted by the second operational amplifier OA2 can satisfy the requirement.

For example, in some embodiments, the power supply circuit 10 is disposed in the power control chip; and the electronic device 20 is a timing controller.

For another example, in some embodiments, in a case where the power supply circuit 10 is disposed in the power control chip, the regulation circuit 40 can also be disposed in the power control chip, so as to simplify the circuit structure and improve the integrity of the voltage regulation system.

For example, in a case where the power supply circuit 10 is disposed in the power control chip, the power control chip can provide the first voltage $V_B$ and the reference voltage $V_C$ inputted into the electronic device 20. For example, the electronic device 20 is a timing controller, the timing controller can receive the first voltage $V_B$ and take the first voltage as the core voltage, and the timing controller can output some control signals for the display panel under a driving of the core voltage, thereby controlling the display panel to perform a normal display operation.

Figure 7:
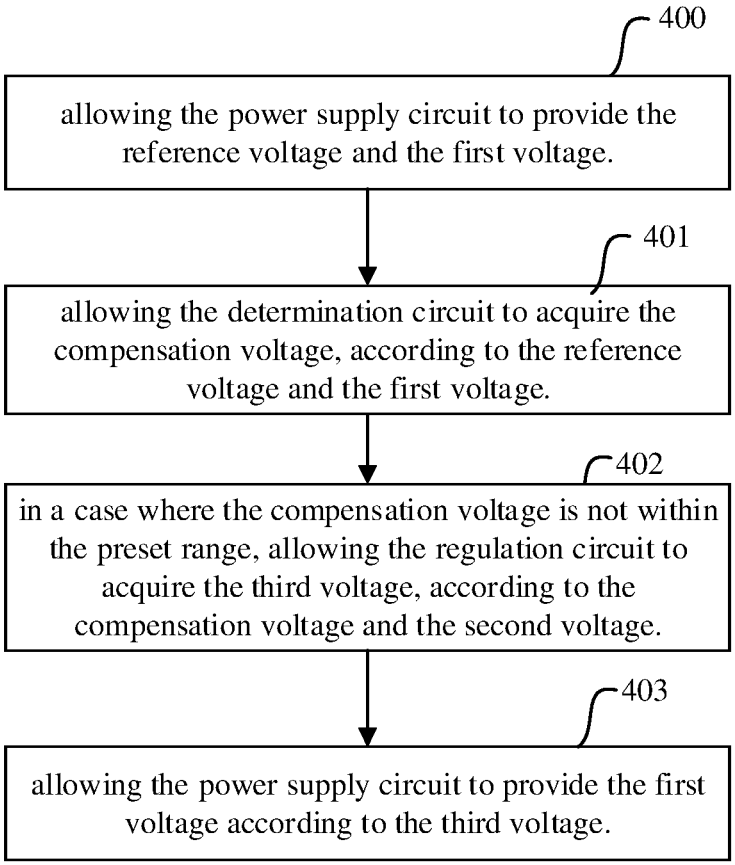
FIG. 7 is a schematic diagram of a voltage regulation method provided by some embodiments of the present disclosure.

Based on the same concept, the embodiment of the present disclosure further provides a voltage regulation method, and the voltage regulation method can be used for the voltage regulation system provided by any embodiment of the present disclosure. It should be noted that, because a system corresponding to the method is the voltage regulation system provided by the embodiment of the present disclosure and a principle of the method for solving a problem is similar to that of the system, the implementation of the method can be referred to the above implementation of the voltage regulation system, and the repeated description will not be repeated As shown in FIG. 7, the voltage regulation method provided by the embodiment of the present disclosure includes the following operation steps.

Step 400: allowing the power supply circuit 10 to provide the reference voltage $V_C$ and the first voltage $V_B$. The first voltage $V_B$ is a voltage inputted into the electronic device 20. The descriptions of the first voltage $V_B$ can refer to the corresponding descriptions of the voltage regulation system, details are not described here again.

Step 401: allowing the determination circuit 30 to acquire the compensation voltage $V_D$, according to the reference voltage $V_C$ and the first voltage $V_B$. For example, in an example, the determination circuit 30 can acquire the compensation voltage $V_D$ by performing a difference process between the reference voltage $V_C$ and the first voltage $V_B$.

S402: in a case where the compensation voltage $V_D$ is not within the preset range, allowing the regulation circuit 40 to acquire the third voltage $V_A$, according to the compensation voltage $V_D$ and the second voltage $V_E$. It should be noted that, the descriptions of the second voltage $V_E$ can refer to the corresponding descriptions of the voltage regulation system, and details are not described here again.

S403: allowing the power supply circuit 10 to provide the first voltage $V_B$ according to the third voltage $V_A$.

As shown in FIG. 3, in a case where the voltage regulation system includes the voltage feedback circuit 50, the voltage regulation method provided by the embodiment of the present disclosure further includes: providing the third voltage $V_A$ outputted by the regulation circuit 40 to the regulation circuit 40 and taking the third voltage $V_A$ as the second voltage $V_E$.

For example, in the $n^{th}$ voltage regulation, the regulation circuit 40 outputs the third voltage $V_A$, and the third voltage $V_A$ can be provided to the voltage feedback circuit 50, and meanwhile, the voltage feedback circuit 50 can also receive the reference voltage $V_C$ provided by the power supply circuit 10; and subsequently, in the $(n+1)^{th}$ voltage regulation, the voltage feedback circuit 50 can acquire the second voltage $V_E$, according to the reference voltage $V_C$ and the third voltage $V_A$, and provide the second voltage $V_E$ to the regulation circuit 40 for a voltage regulation. For example, the second voltage $V_E$ acquired by the regulation circuit 40 in the $(n+1)^{th}$ voltage regulation is equal to the third voltage $V_A$ outputted by the regulation 40 in the $n^{th}$ voltage regulation.

As shown in FIG. 6, in a case where the voltage regulation system includes the second switch K2, the processing circuit 43 an the second operational amplifier OA2, the above step 402 can include the following operation.

In a case where the processing circuit 43 determines that the compensation voltage $V_D$ is not within the preset range, allowing the second switch K2 to be in a turn-on state, so as to input the compensation voltage $V_D$ into the second operational amplifier OA2.

As shown in FIG. 5 and FIG. 6, in a case where the voltage regulation system includes the eighth resistor R8 and the eighth resistor R8 is a variable resistor, the above step 402 can include the following operation.

Regulating a voltage value of the third voltage $V_A$ outputted by the regulation circuit 40 by adjusting the resistance of the eighth resistor R8.

For example, in the voltage regulation method provided by one embodiment of the present disclosure, the above step 402 can include the following operations.

Increasing the voltage value of the third voltage $V_A$ outputted by the regulation circuit 40 if the compensation voltage $V_D$ is greater than a maximum value of the preset range; and reducing the voltage value of the third voltage $V_A$ outputted by the regulation circuit 40 if the compensation voltage $V_D$ is less than a minimum value of the preset range.

For example, in an embodiment, the preset range is −0.2V~0.2V, and the compensation voltage $V_D$ outputted by the determination circuit 30 is 0.3V; the compensation voltage $V_D$ is not within the preset range and is greater than the maximum value of the preset range; and meanwhile, increasing the voltage value of the third voltage $V_A$ outputted by the regulation circuit 40. For example, in a case where the eighth resistor R8 is a variable resistor, the voltage value of the third voltage $V_A$ outputted by the regulation circuit 40 can be increased by increasing the resistance of the eighth resistor R8.

For example, in an embodiment, the preset range is −0.2V~0.2V, and the compensation voltage $V_D$ outputted by the determination circuit 30 is −0.3V; the compensation voltage $V_D$ is not within the preset range and is less than the minimum value of the preset range; and meanwhile, reducing the voltage value of the third voltage $V_A$ outputted by the regulation circuit 40. For example, in a case where the eighth resistor R8 is a variable resistor, the voltage value of the third voltage $V_A$ outputted by the regulation circuit 40 can be reduced by reducing the resistance of the eighth resistor R8.

In the embodiment of the present disclosure, the regulation circuit 40 determines whether the compensation voltage $V_D$ is within the preset range and then correspondingly regulates the first voltage $V_B$ according to a determination result to ensure that the compensation voltage $V_D$ is within the preset range, and the first voltage $V_B$ is provided by the power supply circuit 10 is inputted into the electronic device 20. Thus, the first voltage $V_B$ inputted into the electronic device 20 can be kept stable, and then, for example, the risk of abnormal display of the display panel can be reduced.

Figure 8:
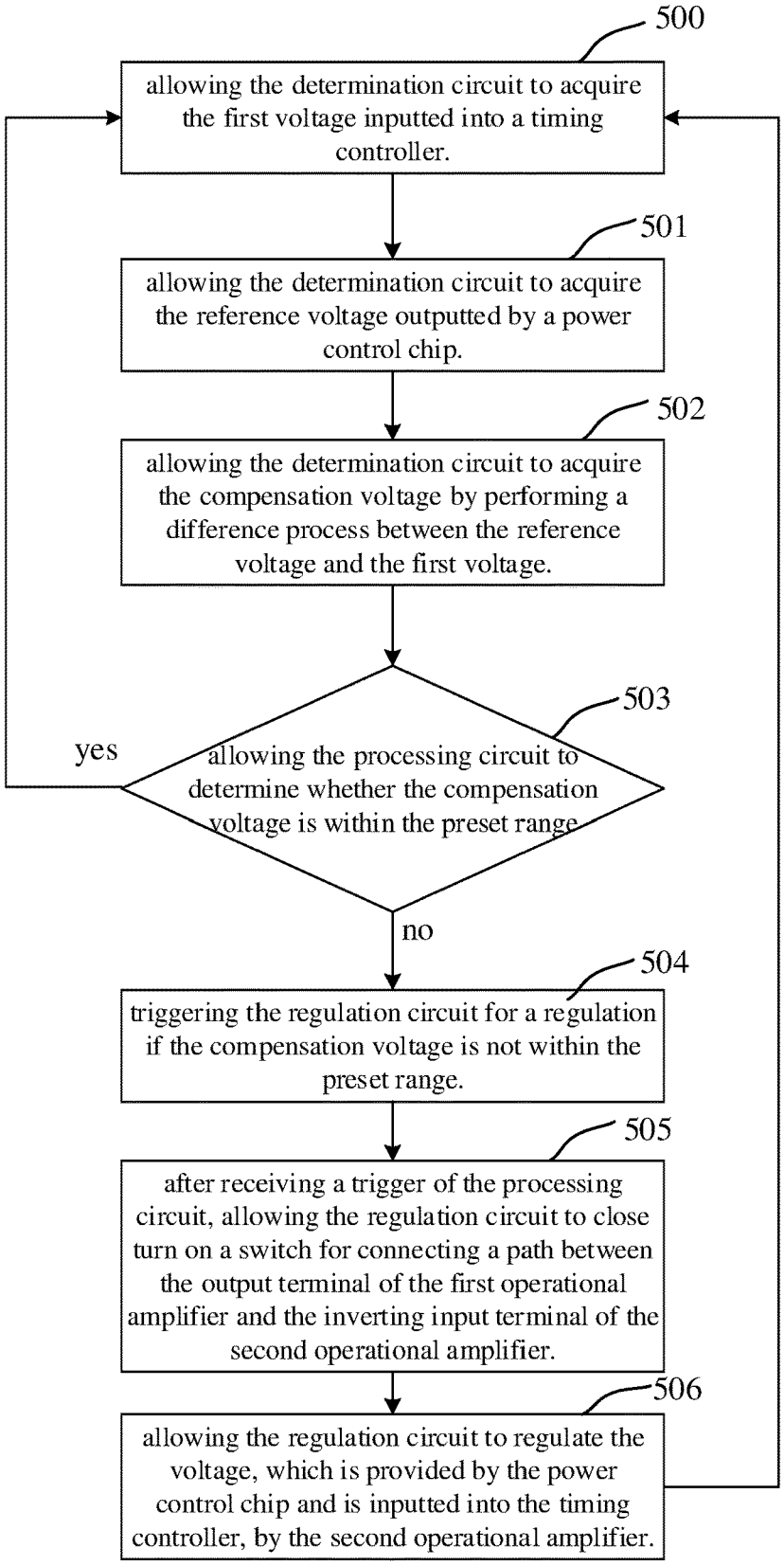
FIG. 8 is a schematic diagram of another voltage regulation method provided by some embodiments of the present disclosure.

As shown in FIG. 8, some embodiments of the present disclosure further provide a voltage regulation method, and the method includes the following operations.

Step 500: allowing the determination circuit 30 to acquire the first voltage $V_B$ inputted into a timing controller.

Step 501: allowing the determination circuit 30 to acquire the reference voltage $V_C$ outputted by a power control chip.

Step 502: allowing the determination circuit 30 to acquire the compensation voltage $V_D$ by performing a difference process between the reference voltage $V_C$ and the first voltage $V_B$.

Step 503: allowing the processing circuit 43 to determine whether the compensation voltage $V_D$ is within the preset range, executing the step 500 if the compensation voltage $V_D$ is within the preset range, or executing the step 504 the compensation voltage $V_D$ is not within the preset range. For example, as shown in FIG. 6, the processing circuit 43 is a circuit disposed in the regulation circuit 40.

Step 504: triggering the regulation circuit 40 for a regulation if the compensation voltage $V_D$ is not within the preset range.

Step 505: after receiving a trigger of the processing circuit 43, allowing the regulation circuit 40 to turn on a switch for connecting a path between the output terminal of the first operational amplifier OA1 and the inverting input terminal of the second operational amplifier OA2. For example, the switch is the second switch K2 as shown in FIG. 5 or FIG. 6.

Step 506: allowing the regulation circuit 40 to regulate the voltage, which is provided by the power control chip and is inputted into the timing controller, by the second operational amplifier OA2.

The voltage regulation method provided by the embodiment can improve the stability of the timing controller, and then can improve the stability of the display panel to which the timing controller is applied, and thereby avoiding the abnormal display of the display panel.

Figure 9:
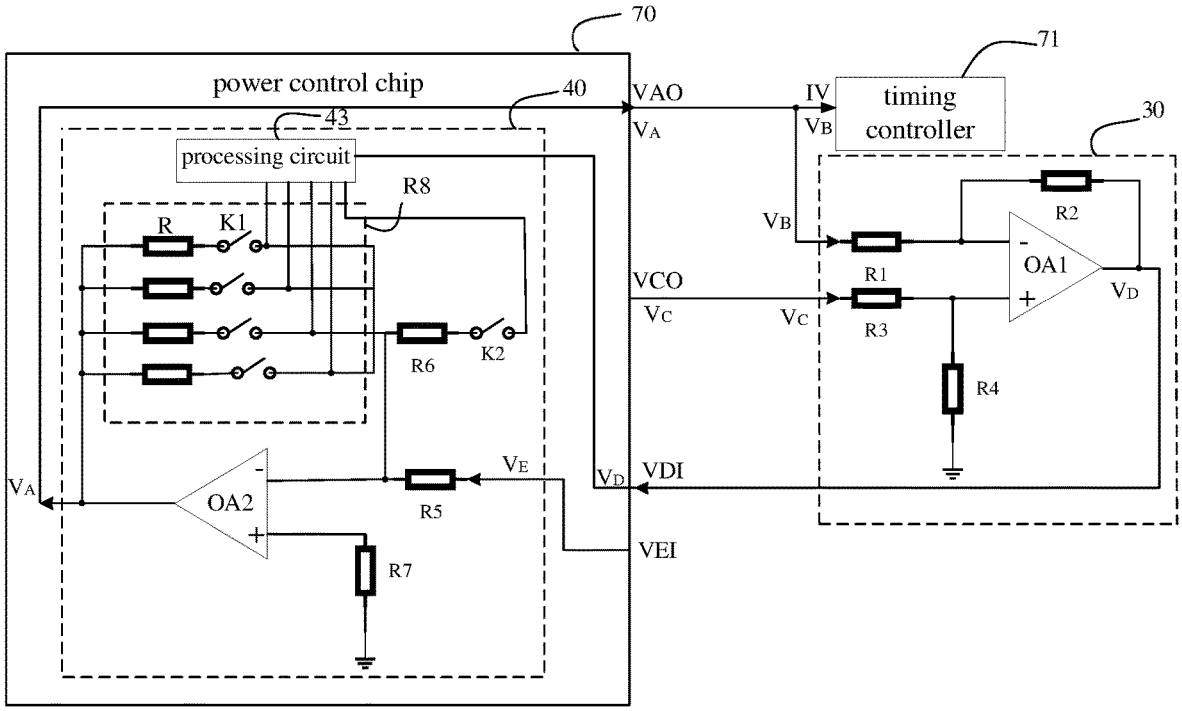
FIG. 9 is a circuit diagram of a driving circuit provided by some embodiments of the present disclosure.

As shown in FIG. 9, some embodiments of the present disclosure further provide a driving circuit. The driving circuit is used for driving a timing controller 71, and the driving circuit includes a power control chip 70 and a determination circuit 30.

The timing controller 71 includes a core voltage input terminal IV. For example, the core voltage input terminal IV is configured to receive the first voltage $V_B$ and take the first voltage $V_B$ as the core voltage for driving a core chip of the timing controller 71. The determination circuit 30 includes a first operational amplifier OA1, a first resistor R1, a second resistor R2, a third resistor R3 and a fourth resistor R4.

The power control chip 70 includes a reference voltage output terminal VCO, a compensation voltage input terminal VDI, a second voltage input terminal VEI, a third voltage output terminal VAO, a processing circuit 43, a second operational amplifier OA2, a fifth resistor R5, a sixth resistor R6, a seventh resistor R7, an eighth resistor R8 and a second switch K2.

A first terminal of the first resistor R1 is connected with the core voltage input terminal IV so as to receive the first voltage $V_B$, and a second terminal of the first resistor R1 is connected with an inverting input terminal of the first operational amplifier OA1. A first terminal of the second resistor R2 is connected with the inverting input terminal of the first operational amplifier OA1, and a second terminal of the second resistor R2 is connected with an output terminal of the first operational amplifier OA1. A first terminal of the third resistor R3 is connected with the reference voltage output terminal VCO so as to receive a reference voltage $V_C$, and a second terminal of the third resistor R3 is connected with a non-inverting input terminal of the first operational amplifier OA1. A first terminal of the fourth resistor R4 is connected with the non-inverting input terminal of the first operational amplifier OA1, and a second terminal of the fourth resistor R4 is grounded. The output terminal of the first operational amplifier OA1 is connected with the compensation voltage input terminal VDI of the power control chip 70 so as to provide the compensation voltage $V_D$ for the power control chip 70.

The processing circuit 43 is connected with the compensation voltage input terminal VDI and the second switch K2. The second switch K2 is also connected with a first terminal of the sixth resistor R6. A second terminal of the sixth resistor R6 is connected with an inverting input terminal of the second operational amplifier OA2. A first terminal of the fifth resistor R5 is connected with the second voltage input terminal VEI so as to receive a second voltage $V_E$, and a second terminal of the fifth resistor R5 is connected with the inverting input terminal of the second operational amplifier OA2. A first terminal of the seventh resistor R7 is connected with a non-inverting input terminal of the second operational amplifier OA2, and a second terminal of the seventh resistor R7 is grounded. A first terminal of the eighth resistor R8 is connected with the inverting input terminal of the second operational amplifier OA2, and a second terminal of the eighth resistor R8 is connected with an output terminal of the second operational amplifier OA2. The output terminal of the second operational amplifier OA2 is connected with the third voltage output terminal VAO of the power control chip 70 so as to output a third voltage $V_A$.

It should be noted that, the type of the eighth resistor R8 is not limited in the embodiment of the present disclosure. For example, the eighth resistor R8 can be a resistor with a fixed resistance. For another example, as shown in FIG. 9, the eighth resistor R8 is a variable resistor.

For example, as shown in FIG. 9, in an example, the eighth resistor R8 is a variable resistor and includes N resistors R and N first switches K1. The N resistors R and the N first switches K1 are in one-to-one correspondence. A first terminal of each resistor R of the N resistors R is connected with the inverting input terminal of the second operational amplifier OA2 through a corresponding first switch K1, and a second terminal of each resistor R of the N resistors R is connected with the output terminal of the second operational amplifier OA2.

As shown in FIG. 9, the eighth resistor R8 includes 4 resistors R, but is not limited to 4 in actual application, and the number and the resistance value of the resistors R of the eighth resistor R8 can be set according to an actual condition.

The embodiment of the present disclosure further provides a display device 1, and the display device 1 includes any voltage regulation system 100 provided by the embodiment of the present disclosure, a timing controller 71 and a display panel 200.

The voltage regulation system 100 is configured to drive the timing controller 71. For example, in an example, the voltage regulation system 100 is configured to provide a stable core voltage for the timing controller 71, and the core voltage is, for example, a voltage for driving a core chip of the timing controller 71.

Figure 10:
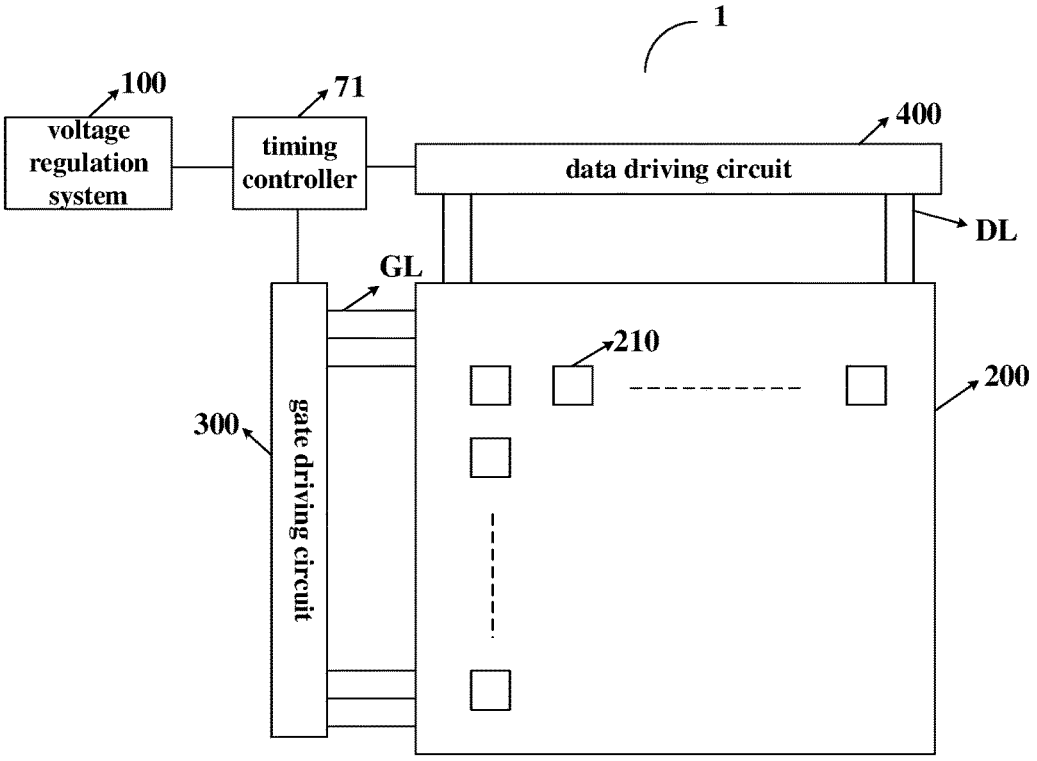
FIG. 10 is a schematic diagram of a display device provided by some embodiments of the present disclosure.

The timing controller 71 is configured to provide control signals for the display panel 200. For example, as shown in FIG. 10, the display device 1 further includes a gate driving circuit 300 and a data driving circuit 400. The timing controller 71 is respectively connected with the gate driving circuit 300 and the data driving circuit 400 to provide the control signals.

As shown in FIG. 10, the display device 1 includes a display panel 200. A pixel array composed of a plurality of subpixel units 210 is disposed in the display panel 200.

For example, an output terminal of each stage of shift register unit in the gate driving circuit 300 is respectively electrically connected with subpixel units 210 at different rows. For example, the gate driving circuit 300 is electrically connected with the subpixel units 210 through a gate line GL. The gate driving circuit 300 is configured to provide a driving signal to the pixel array. For example, the driving signal can drive a scanning transistor in the subpixel unit 210.

For example, the data driving circuit 400 is configured to provide data signals to the pixel array. For example, the data driving circuit 400 is electrically connected with the subpixel units 210 through a data line DL.

It should be noted that the display device 1 in this embodiment can be a liquid crystal panel, a liquid crystal television, a display, an OLED panel, an OLED television, an electronic paper, a mobile phone, a tablet computer, a notebook computer, a digital photo frame, a navigator and other products or members having display function. The display device 1 further includes other conventional members, such as a display panel, which are not limited by the embodiments of the present disclosure.

The display device 1 provided by the embodiment of the present disclosure can regulate and stabilize the voltage provided to the timing controller 71 by adopting the voltage regulation system 100, and then can improve the stability of the timing controller 71 during work, thereby improving the stability of the display panel 200 (the display device 1) during work and avoiding the abnormal display of the display panel 200 (the display device 1).

The present disclosure is described with reference to flowcharts and/or block diagrams of methods, systems (devices), and computer program products according to the embodiments of the present disclosure. It should be understood that, each of the processes and/or blocks in the flowcharts and/or block diagrams, and the combinations of the processes and/or blocks in the flowcharts and/or block diagrams can be implemented by computer program instructions. The computer program instructions can be provided to a processing circuit of a general purpose computer, a special purpose computer, an embedded processor, or other programmable data processing systems to produce a machine instruction, so the instruction executed by the processing circuit of the computer or other programmable data processing system can generate a method for implementing functions specified in one or more processes of a flowchart and/or one or more blocks of a block diagram.

The computer program instructions can also be stored in a computer readable memory that can direct the computer or other programmable data processing system to operate in a particular manner, such that the instructions stored in the computer readable memory can produce a product including an instruction device. The instruction device implements the functions specified in one or more processes in the flow chart and/or one or more blocks in the block diagram.

These computer program instructions can also be loaded onto a computer or other programmable data processing system to execute a series of operational steps on the computer or other programmable system so as to produce computer-implemented processing, so the instructions executed on the computer or other programmable system can provide steps for implementing the functions specified in one or more processes in the flow chart and/or one or more blocks in the block diagram.

While the preferred embodiment of the present disclosure has been described, additional changes and modifications can be made by those skilled in the art to these embodiments once the basic inventive concept is known. Therefore, the appended claims are intended to be construed as including the preferred embodiments and all the changes and modifications falling into the scope of the present disclosure.

It will be apparent to those skilled in the art that various changes and modifications can be made in the present disclosure without departing from the spirit and scope of the present disclosure. Thus, in the event that these modifications and changes of the present disclosure fall within the scope of the claims of the present disclosure and equivalents thereof, the present disclosure is also intended to include these modifications and changes.

What is claimed is:

1. A voltage regulation system, applicable to an electronic device, comprising a power supply circuit, a determination circuit and a regulation circuit, wherein the power supply circuit is connected with the regulation circuit, and the power supply circuit is configured to provide a reference voltage and provide a first voltage inputted into the electronic device;

the determination circuit is connected with the power supply circuit, and the determination circuit is configured to, according to the reference voltage and the first voltage, output a compensation voltage;

the regulation circuit is connected with the determination circuit so as to receive the compensation voltage, and the regulation circuit is configured to output a third voltage, according to the compensation voltage and a second voltage, in a case where the compensation voltage is not within a preset range; and the power supply circuit is further configured to provide the first voltage according to the third voltage, and the second voltage is the reference voltage or a voltage acquired based on a variation of the reference voltage.

2. The voltage regulation system according to claim 1, further comprising a voltage feedback circuit, wherein the voltage feedback circuit is connected with the regulation circuit, and the voltage feedback circuit is configured to acquire the second voltage, according to the reference voltage and the third voltage, when the regulation circuit outputs the third voltage, and provide the second voltage to the regulation circuit.

3. The voltage regulation system according to claim 1, wherein the determination circuit is configured to acquire the compensation voltage by performing a difference process between the reference voltage and the first voltage.

4. The voltage regulation system according to claim 1, wherein the second voltage is equal to the reference voltage.

5. The voltage regulation system according to claim 1, wherein the determination circuit comprises a first operational amplifier, a first resistor, a second resistor, a third resistor and a fourth resistor;

a first terminal of the first resistor is configured to receive the first voltage, and a second terminal of the first resistor is connected with an inverting input terminal of the first operational amplifier;

a first terminal of the second resistor is connected with the inverting input terminal of the first operational amplifier, and a second terminal of the second resistor is connected with an output terminal of the first operational amplifier;

a first terminal of the third resistor is configured to receive the reference voltage, and a second terminal of the third resistor is connected with a non-inverting input terminal of the first operational amplifier;

a first terminal of the fourth resistor is connected with the non-inverting input terminal of the first operational amplifier, and a second terminal of the fourth resistor is grounded; and the output terminal of the first operational amplifier is configured to output the compensation voltage.

6. The voltage regulation system according to claim 1 wherein the regulation circuit comprises a second operational amplifier, a fifth resistor, a sixth resistor, a seventh resistor and an eighth resistor;

a first terminal of the fifth resistor is configured to receive the second voltage, and a second terminal of the fifth resistor is connected with an inverting input terminal of the second operational amplifier;

a first terminal of the sixth resistor is configured to receive the compensation voltage, and a second terminal of the sixth resistor is connected with the inverting input terminal of the second operational amplifier;

a first terminal of the seventh resistor is connected with a non-inverting input terminal of the second operational amplifier, and a second terminal of the seventh resistor is grounded;

a first terminal of the eighth resistor is connected with the inverting input terminal of the second operational amplifier, and a second terminal of the eighth resistor is connected with an output terminal of the second operational amplifier; and the output terminal of the second operational amplifier is configured to output the third voltage.

7. The voltage regulation system according to claim 6, wherein the eighth resistor is a variable resistor, the eighth resistor comprises N resistors and N first switches, and the regulation circuit further comprises a first processing circuit;

the N resistors and the N first switches are in one-to-one correspondence;

a first terminal of each resistor of the N resistors is connected with the inverting input terminal of the second operational amplifier through a corresponding first switch of the N first switches, and a second terminal of each resistor of the N resistors is connected with the output terminal of the second operational amplifier;

the first processing circuit is connected with the determination circuit and the N first switches of the eighth resistor, and the first processing circuit is configured to control each of the N first switches of the eighth resistor to be in a turn-off state or a turn-on state in a case where the compensation voltage is not within the preset range; and N is an integer greater than 1.

8. The voltage regulation system according to claim 7, wherein the regulation circuit further comprises a second switch and a second processing circuits;

the second switch is connected with the first terminal of the sixth resistor and the second processing circuit; and the second processing circuit is connected with the determination circuit, and the second processing circuit is configured to control the second switch to be in a turn-off state or a turn-on state.

9. The voltage regulation system according to claim 6, wherein the eighth resistor is a variable resistor, the eighth resistor comprises N resistors and N first switches, and the regulation circuit further comprises a processing circuit and a second switch;

the N resistors and the N first switches are in one-to-one correspondence;

a first terminal of each resistor of the N resistors is connected with the inverting input terminal of the second operational amplifier through a corresponding first switch of the N first switches, and a second terminal of each resistor of the N resistors is connected with the output terminal of the second operational amplifier;

the second switch is connected with the first terminal of the sixth resistor and the processing circuit;

the processing circuit is connected with the second switch, the determination circuit and the N first switches, the processing circuit is configured to control each of the N first switches to be in a turn-off state or a turn-on state in a case where the compensation voltage is not within the preset range, and the processing circuit is configured to control the second switch to be in a turn-off state or a turn-on state in a case where the compensation voltage is not within the preset range; and N is an integer greater than 1.

10. The voltage regulation system according to claim 1, wherein the power supply circuit is disposed in a power control chip.

11. A voltage regulation method of the voltage regulation system according to claim 1, comprising:

allowing the power supply circuit to provide the reference voltage and the first voltage;

allowing the determination circuit to acquire the compensation voltage, according to the reference voltage and the first voltage;

allowing the regulation circuit to acquire the third voltage, according to the compensation voltage and the second voltage, in a case where the compensation voltage is not within the preset range; and allowing the power supply circuit to provide the first voltage according to the third voltage.

12. The voltage regulation method according to claim 11, wherein allowing the determination circuit to acquire the compensation voltage, according to the reference voltage and the first voltage comprises:

allowing the determination circuit to acquire the compensation voltage by performing a difference process between the reference voltage and the first voltage.

13. The voltage regulation method according to claim 11, wherein in a case where the voltage regulation system comprises a voltage feedback circuit, the voltage regulation method further comprises:

providing the third voltage outputted by the regulation circuit to the regulation circuit and taking the third voltage as the second voltage.

14. The voltage regulation method according to claim 11, wherein in a case where the voltage regulation system comprises a second switch, a processing circuit and a second operational amplifier, allowing the regulation circuit to acquire the third voltage, according to the compensation voltage and the second voltage comprises:

in a case where the processing circuit determines that the compensation voltage is not within the preset range, allowing the second switch to be in a turn-on state, so as to input the compensation voltage into the second operational amplifier.

15. The voltage regulation method according to claim 11, wherein in a case where the voltage regulation system comprises a eighth resistor and the eighth resistor is a variable resistor, allowing the regulation circuit to acquire the third voltage, according to the compensation voltage and the second voltage comprises:

regulating a voltage value of the third voltage outputted by the regulation circuit by adjusting a resistance of the eighth resistor.

16. The voltage regulation method according to claim 11, wherein allowing the regulation circuit to acquire the third voltage, according to the compensation voltage and the second voltage comprises:

increasing a voltage value of the third voltage outputted by the regulation circuit if the compensation voltage is greater than a maximum value of the preset range; or reducing the voltage value of the third voltage outputted by the regulation circuit if the compensation voltage is less than a minimum value of the preset range.

17. A driving circuit for driving a timing controller, comprising a power control chip and a determination circuit, wherein the timing controller comprises a core voltage input terminal, the determination circuit comprises a first operational amplifier, a first resistor, a second resistor, a third resistor and a fourth resistor, and the power control chip comprises a reference voltage output terminal, a compensation voltage input terminal, a second voltage input terminal, a third voltage output terminal, a processing circuit, a second operational amplifier, a fifth resistor, a sixth resistor, a seventh resistor, an eighth resistor and a second switch;

a first terminal of the first resistor is connected with the core voltage input terminal, and a second terminal of the first resistor is connected with an inverting input terminal of the first operational amplifier; a first terminal of the second resistor is connected with the inverting input terminal of the first operational amplifier, and a second terminal of the second resistor is connected with an output terminal of the first operational amplifier; a first terminal of the third resistor is connected with the reference voltage output terminal, and a second terminal of the third resistor is connected with a non-inverting input terminal of the first operational amplifier; a first terminal of the fourth resistor is connected with the non-inverting input terminal of the first operational amplifier, and a second terminal of the fourth resistor is grounded; the output terminal of the first operational amplifier is connected with the compensation voltage input terminal;

the processing circuit is connected with the compensation voltage input terminal and the second switch; the second switch is also connected with a first terminal of the sixth resistor; a second terminal of the sixth resistor is connected with an inverting input terminal of the second operational amplifier; a first terminal of the fifth resistor is connected with the second voltage input terminal, and a second terminal of the fifth resistor is connected with the inverting input terminal of the second operational amplifier; a first terminal of the seventh resistor is connected with a non-inverting input terminal of the second operational amplifier, and a second terminal of the seventh resistor is grounded; a first terminal of the eighth resistor is connected with the inverting input terminal of the second operational amplifier, and a second terminal of the eighth resistor is connected with an output terminal of the second operational amplifier; and the output terminal of the second operational amplifier is connected with the third voltage output terminal.

18. The driving circuit according to claim 17, wherein the eighth resistor is a variable resistor, and the eighth resistor comprises N resistors and N first switches;

the N resistors and the N first switches are in one-to-one correspondence;

a first terminal of each resistor of the N resistors is connected with the inverting input terminal of the second operational amplifier through a corresponding first switch of the N first switches, and a second terminal of each resistor of the N resistors is connected with the output terminal of the second operational amplifier; and N is an integer greater than 1.

19. A display device, comprising the voltage regulation system according to claim 1, a timing controller and a display panel, wherein the voltage regulation system is configured to drive the timing controller, and the timing controller is configured to provide control signals to the display panel.

20. The display device according to claim 19, wherein the voltage regulation system is configured to provide a core voltage to the timing controller.

* * * * *